US009728394B2

(12) United States Patent
Imamura

(10) Patent No.: US 9,728,394 B2
(45) Date of Patent: Aug. 8, 2017

(54) EXCIMER DISCHARGE LAMP

(71) Applicant: USHIO DENKI KABUSHIKI KAISHA, Tokyo (JP)

(72) Inventor: Atsushi Imamura, Himeji (JP)

(73) Assignee: USHIO DENKI KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/013,470

(22) Filed: Feb. 2, 2016

(65) Prior Publication Data

US 2016/0225604 A1 Aug. 4, 2016

(30) Foreign Application Priority Data

Feb. 4, 2015 (JP) ..... 2015-020131

(51) Int. Cl.
*H01J 11/00* (2012.01)
*H01J 65/04* (2006.01)
*H01J 61/067* (2006.01)

(52) U.S. Cl.
CPC ..... *H01J 65/046* (2013.01); *H01J 61/0672* (2013.01)

(58) Field of Classification Search
CPC ..... H01J 61/368; H01J 61/06
USPC ..... 313/607, 594
See application file for complete search history.

(56) References Cited

FOREIGN PATENT DOCUMENTS

JP 2014-154274 A 8/2014

OTHER PUBLICATIONS

Japanese Office Action issued by the Japanese Patent Office corresponding to JP2015-020131, issued on Jul. 7, 2015.

*Primary Examiner* — Vip Patel
(74) *Attorney, Agent, or Firm* — Studebaker & Brackett PC

(57) ABSTRACT

Disclosed herein an excimer discharge lamp that is capable of mitigating a stress concentration occurring due to a fixing method of an outer electrode, and achieving a desired life of lamp in an ensured manner. The excimer discharge lamp comprises: an arc tube for enclosing a luminous gas inside and having a sealing portion formed contiguous to, via a reduced diameter portion, one end of a tube shaped luminous portion; and an outer electrode of a net-like shape arranged on an outer peripheral surface of the art tube. The one end of the outer electrode being fixed via an outer electrode fixing member provided on an outer surface of the sealing portion.

3 Claims, 5 Drawing Sheets

PRIOR ART

PRIOR ART

EXCIMER DISCHARGE LAMP

FIELD OF THE INVENTION

The present invention relates to an excimer discharge lamp that is usable for, for example, an optical cleaning treatment or a sterilization treatment or the like.

DESCRIPTION OF THE RELATED ART

Recent years, an excimer discharge lamp has been used as a light source for various devices such as an optical cleaning treatment device or a sterilization treatment device.

Certain type of excimer discharge lamp has been widely employed in which an electrode (i.e., an outer electrode) is arranged on an outer surface of an arc tube composed of a dielectric material having a light permeability and an inner electrode is arranged inside the arc tube (see, e.g., Japanese Patent Application Laid-open Publication No. 2014-154274A: Patent Literature 1).

FIG. 6 is a perspective view schematically illustrating a configuration of an exemplary conventional excimer discharge lamp. FIG. 7 is an enlarged cross sectional view illustrating a configuration of a main part of the excimer discharge lamp shown in FIG. 6 in the longitudinal direction.

This type of conventional excimer discharge lamp comprises an arc tube 60 in which a luminous gas is enclosed inside. A sealing portion 63 is formed at one end of the arc tube 60. The sealing portion 63 has a so called foil sealing structure (for example, a pinch seal structure) in which a metallic foil 68 is buried and air tightly sealed (for example, a pinch seal structure). Also, the sealing portion 63 is contiguous to (towards) the other end of a luminous portion 61 of a circular tube shape via a curved reduced diameter portion 62.

Yet also, a tip portion 65, which is a residuary part of an exhaust passage for exhausting inside the arc tube 60 during the lamp fabrication process, is provided at the other end of the arc tube 60.

On an outer surface of the arc tube 60, an external electrode 80 is arranged such that the external electrode 80 closely (tightly) contacts the outer surface of the arc tube 60. The external electrode 80 is configured with, for example, a net-like (reticular or mesh) shaped electrode that is formed by a plurality of metal fine wires having an electrical conductivity.

Furthermore, inside the arc tube 60, an inner electrode 70 is arranged such that the inner electrode 70 extends along a longitudinal direction of the arc tube 60. A main part of the inner electrode 70 is configured with a coiled electrode which is formed in a wound (winded) spiral shape. One end of the inner electrode 70 is located inside the tip portion 65, and the other end of the inner electrode 70 is electrically connected to the metallic foil 68 which is buried in the sealing portion 63. An external (exterior) lead 75 that protrudes and extends outwardly from the other end of the arc tube 60 is electrically connected to the metallic foil 68.

In the conventional excimer discharge lamp having the above mentioned configuration, the external electrode 80 needs to be fixed so as not to move or translate unintentionally. A more particular fixing method of the external electrode 80 will be described below. One end of the external electrode 80 is fixed to the arc tube 60 by winding a metal wire 85 such as a soft Ni wire or the like around a vicinity of a boundary portion between the reduced diameter portion 62 and the sealing portion 63 on the outer surface of the arc tube 60.

LISTING OF REFERENCES

Patent Literatures

Patent Literature 1: Japanese Patent Application Laid-open Publication No. 2014-154274A

SUMMARY OF THE INVENTION

Problems to be Solved by the Invention

In the meantime, in the above configured excimer discharge lamp, the sealing portion 63 is formed by heating an end part of an arc tube forming material, which constitutes the arc tube 60 and is composed of, for example, quartz glass, and by flatly crushing the heated end part of the arc tube forming material by a pincher. At this moment, because the arc tube forming material is cooled rapidly after the arc tube forming material is once heated, a distortion (i.e., thermal distortion or strain) due to the temperature (temperature change) would remain in the sealing portion 63.

Also, in the excimer discharge lamp that emits vacuum ultraviolet light, an ultraviolet light distortion (or ultraviolet distortion) is being accumulated in addition to the above mentioned distortion (i.e., the thermal distortion) as a result that an inner face of the arc tube 60 is irradiated with the ultraviolet light having a short wavelength during the lighting operation.

In particular, as a reduced diameter portion 62 of the art tube 60 undergoes a larger deformation of glass, which constitutes the arc tube 60, a thermal distortion is likely to remain. As such, in the region in which the reduced diameter portion 62 is located, the discharge occurs between the inner electrode 70 and the outer electrode 80 and also the ultraviolet light distortion occurs as well due to the ultraviolet light irradiation. As a result, the residual distortion and the accumulation thereof would become considerable.

In such region in which the distortion is likely to remain or accumulate, when the outside electrode 80 is fixed by way of winding the metal wire 85 such as the Ni wire as the conventional fixing method, there is a problem that such region is likely to undergo the stress concentration so that the arc tube 60 may be broken before the end of the prescribed life of lamp.

The present invention has been made in view of the above mentioned circumstances and its object is to provide an excimer discharge lamp that is capable of mitigating (suppressing) the stress concentration which occurs due to the fixing method of the external electrode and also achieving the prescribed life of lamp in an ensured manner.

Solution to the Problem

According to one aspect of the present invention, there is provided an excimer discharge lamp comprising: an arc tube for enclosing a luminous gas inside and having a sealing portion formed contiguous to, via a reduced diameter portion, one end of a tube shaped luminous portion; and an outer electrode of a net-like shape arranged on an outer peripheral surface of the art tube, and one end of the outer electrode being fixed via an outer electrode fixing member provided on an outer surface of the sealing portion.

According to another aspect of the present invention, there is provided an excimer discharge lamp comprising: an arc tube for enclosing a luminous gas inside and having a sealing portion formed contiguous to, via a reduced diameter portion, one end of a tube shaped luminous portion; and an outer electrode of a net-like shape arranged on an outer peripheral surface of the art tube, and one end of the outer electrode being retained (hold) and fixed by a retaining member that allows the one end of the outer electrode to surface contact an outer surface of the sealing portion in a state that the one end of the outer electrode is positioned on the outer surface of the sealing portion.

Moreover, according to the excimer discharge lamp according to yet another aspect of the present invention, the outer electrode fixing member may be configured with a base member attached to the sealing portion.

Advantageous Effect of the Invention

According to the excimer discharge lamp of one or more embodiments of the present invention, the external electrode is configured such that the external electrode extends in an arc tube axis direction of the arc tube to a position outside from the reduced diameter portion in which the thermal distortion, which is generated during the lamp fabrication process, and the ultraviolet light distortion due to the discharge are likely to be accumulated.

Also, the external electrode is configured such that one end of the external electrode is fixed at a position on the sealing portion.

For this reason, according to the excimer discharge lamp of the present invention, it makes it possible to reduce the mechanical stress acting to the reduced diameter portion, and also to avoid the stress concentration to occur in the reduce diameter portion.

Furthermore, because the external electrode can be in a state that the external electrode is positioned apart from an outer surface of the reduced diameter portion, it makes it possible to suppress the vacuum ultraviolet light to emit in the reduced diameter portion and also to mitigate the ultraviolet distortion to be accumulated in the reduced diameter portion. As a result, the lamp breakage in the last phase of the life of lamp can be effectively prevented in an ensured manner so that a desired life of lamp can be achieved in an ensured manner.

These and other objects, aspects and advantages of the present invention will become apparent to a skilled person from the following detailed description when read and understood in conjunction with the appended claims and drawings.

DETAILED DESCRIPTION OF THE INVENTION

Hereinafter, embodiments of an excimer discharge lamp according to the present invention will be described in detail with reference to the drawings attached hereto.

First Embodiment

Figure 1A:
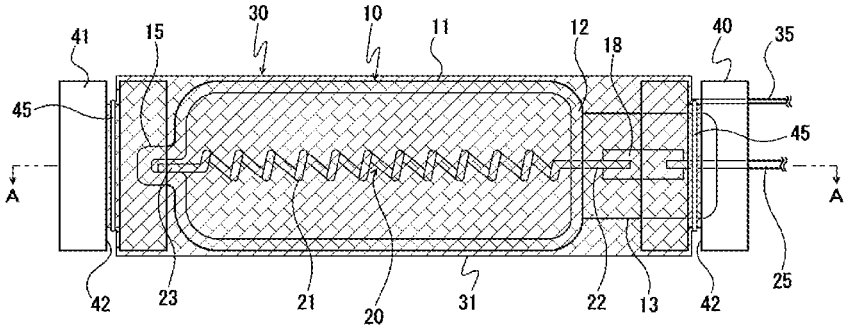
FIG. 1A is a plain view schematically showing an exemplary configuration according to one embodiment of the excimer discharge lamp of the present invention.
Figure 1B:
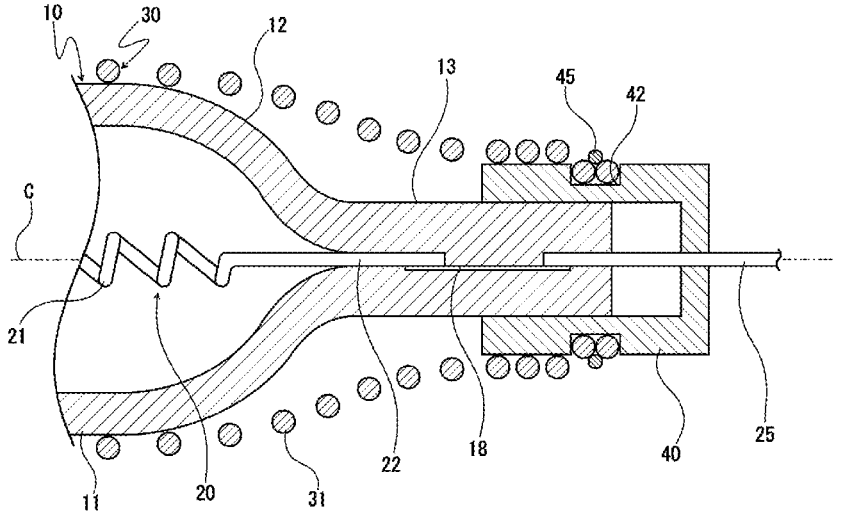
FIG. 1B is an enlarged cross sectional view showing a part of the excimer discharge lamp along A-A line shown in FIG. 1A.

FIG. 1A is a plain view schematically showing an exemplary configuration according to one embodiment of an excimer discharge lamp of the present invention. FIG. 1B is an enlarged cross sectional view showing a part of the excimer discharge lamp shown in FIG. 1A along A-A line shown in FIG. 1A.

The excimer discharge lamp comprises an arc tube 10 that has an ultraviolet light permeability and is composed of a dielectric material such as synthetic quartz glass or the like.

The art tube 10 includes a luminous portion 11 having a circular tube shape, and a sealing portion 13 which is contiguous (continuous) to one end of the luminous portion 11 via a reduced diameter portion 12.

At the other end of the arc tube 10, a tip portion 15 is formed that is a residual part of an exhaust passage for exhausting inside the arc tube 10 during the lamp fabrication process.

A sealing portion 13 has a so called the foil sealing structure in which a metallic foil 18 is buried and sealed in an air tight manner (hermetically). The sealing portion 13 is formed, for example, by heating an end of the arc tube forming material, which constitutes the art tube 10, and then flatly crushing (collapsing) the heated arc tube forming material by a pincher (that is, a pinch seal structure).

Here, the reduced diameter portion 12 is formed when the end of the arc tube forming material is crushed (collapsed) and sealed. The reduced diameter portion 12 includes an inclined plane continuous (contiguous) from the luminous portion 11 to the sealing portion 13 and configured such that a diameter (i.e., outer diameter) of the arc tube 10 becomes gradually being reduced towards the sealing portion 13. In the reduced diameter portion 12, an inner wall of the arc tube 10 becomes closer (approaching) to the inner electrode 20, which will be described below, towards the sealing portion 13.

At both ends of the arc tube 10, cylindrical shaped base members 40 and 41 are provided that are composed of, for example, inorganic ceramics (e.g., alumina) or the like, respectively. The base members 40 and 41 are fixed to the arc tube 10 by, for example, an inorganic adhesive. On each of outer peripheral surfaces of the base materials 40 and 41, a groove portion 42 is formed that extends around the entire periphery in a circumferential direction.

Inside the arc tube 10, a luminous gas is enclosed, and an inner electrode 20 is arranged such that the inner electrode 20 extends along a tube axis C of the arc tube 10.

As the luminous gas, a rare gas having an acting (function) as a discharge medium that forms an excimer molecular by an excimer discharge can be used. The rare gas includes, for example, a xenon gas (Xe), an argon gas (Ar), and a krypton gas (Kr) and the like.

Furthermore, as the discharge medium, as appropriate along with the rare gas, a halogen gas such as a fluorine gas (F), a chlorine gas (Cl), an iodine gas (I), and a bromine gas (Br) and the like can be used.

The inner electrode 20 is composed of, for example, a metal having a heat resistance property such as tungsten. The inner electrode 20 includes a coiled part 21, which is formed by winding a metal element wire in a coiled shape, and lead parts 22 and 23 extending in an approximately linear manner, which are arranged at both ends of the coined part 21, respectively. The inner electrode 20 is arranged such that a central axis of the coiled part 21 is consonant with (correspond to) a tube axis C of the arc tube 10. One end of one lead part 22 is electrically connected to the other end of the metallic foil 18 buried in the sealing portion 13, and the other end of the other lead part 23 is positioned inside the tip portion 15.

One end of the metallic foil 18 is electrically connected to the other end of an outer lead 25 which protrudes and extends outwardly in the tube axis direction from an outer end of the sealing portion 13. With the above mentioned configuration, the inner electrode 29 is electrically connected to the outer lead 25 via the metallic foil 18.

On an outer surface of the arc tube 10, a net-like (reticular) outer electrode 30 is arranged such that the outer electrode 30 extends along the tube axis direction of the arc tube 10. The outer electrode 30 is connected to a power source, which is not shown, via a wiring 35 which penetrates one of the base member 40 to extend, and has a function as, for example, a ground electrode.

The outer electrode 30 in this example is configured with an electrode forming member in a net-like shape (hereinafter also referred to as "net-like electrode forming member") that is formed, for example, by knitting a plurality of metal element wires having an electrical conductivity such that the metal element wires have a cylindrical shape. The strand diameter of the metal element wire, which constitutes the net-like electrode forming member 31, is, for example, ϕ0.01 mm to ϕ1.0 mm.

In the meantime, in the above mentioned excimer discharge lamp, one end of the outer electrode 30 is fixed to the arc tube 10 via an outer electrode fixing member which is arranged on an outer surface of the sealing portion 13 formed in the arc tube 10.

A particular fixing method of the outer electrode 30 will be described below in detail. One end of the net-like electrode forming member 31, which constitutes the outer electrode 30, is fixed in a state that a metal element wire is fitted into the groove portion 42 of one of the base member 40, which is used as the outer electrode fixing member, and positioned therein and that the electrode fixing wire 45 composed of, for example, the Ni wire, is wound along with the wiring 35 around the groove portion 42.

Likewise, the other end of the net-like electrode member 31 is fixed in a state that the other end of the net-like electrode member 31 is positioned inside the groove portion 42 of the other base member 41 and that the electrode fixing wire 45 composed of, for example, the Ni wire, is wound around the groove portion 42. The strand diameter of the electrode fixing wire 45 is, for example, ϕ0.1 mm to ϕ1.0 mm.

By fixing the net-like electrode forming member 31, which constitutes the external electrode 30, to the arc tube 10 in the above mentioned manner, the net-like electrode forming member 31 is configured such that the metal element wire, which constitutes the net-like electrode forming member 31, closely contacts the outer surface of the luminous portion 11 of the arc tube 10, while the metal element wire, which constitutes the reticular electrode forming member 31, is positioned via a gap with respect to the outer surface of the reduced diameter portion 12 and the outer peripheral surface of the sealing portion 13 of the arc tube 10 (that is, in the state apart from the outer surface of the reduced diameter portion and the outer peripheral surface of the sealing portion 13).

In the above mentioned excimer discharge lamp, a high frequency high voltage is applied between the inner electrode 20 and the outer electrode 30 by a power source, which is not shown, so that an excimer discharge occurs in an inner space of the arc tube 10. Subsequently, the excimer molecular is formed by the excimer discharge, the vacuum ultraviolet light emitted from the formed excimer molecular transmits (permeates) the arc tube 10, and then the transmitted vacuum ultraviolet light is irradiated through a gap between an reticulation (mesh) of the net-like electrode forming member 31, which constitutes the outer electrode 30.

As described above, in the above mentioned excimer discharge lamp, the outer electrode 30 is configured such that the outer electrode 30 extends to the position outside from (of) the reduced diameter portion 12, which is likely to undergo the thermal distortion occurred during the lamp fabrication process or the ultraviolet light distortion due to the discharge, in the tube axis direction of the arc tube 10, and that one end of the outer electrode 30 is fixed at the position on the sealing portion 13.

For this reason, according to the above mentioned excimer discharge lamp, it makes it possible to reduce the mechanical stress acting (applied) to the reduced diameter portion 12 of the arc tube 10, which occurs with the outer electrode 30 being fixed by winding the electrode fixing wire 45, and also to avoid the stress concentration to occur in the reduced diameter portion 12.

Furthermore, because the metal element wire of the reticular electrode forming member 31, which constitutes the outer electrode 30, is positioned apart from the outer surface of the reduced diameter portion 12, it makes it possible to suppress the vacuum ultraviolet light to emit (to be generated) in the reduced diameter portion 12 and to mitigate the ultraviolet distortion to be accumulated in the reduced diameter portion 12. As a result, the lamp breakage in the last phase of the life of lamp can be prevented in an ensured manner so that the desired life of lamp can be achieved in an ensured manner.

Second Embodiment

Figure 2A:
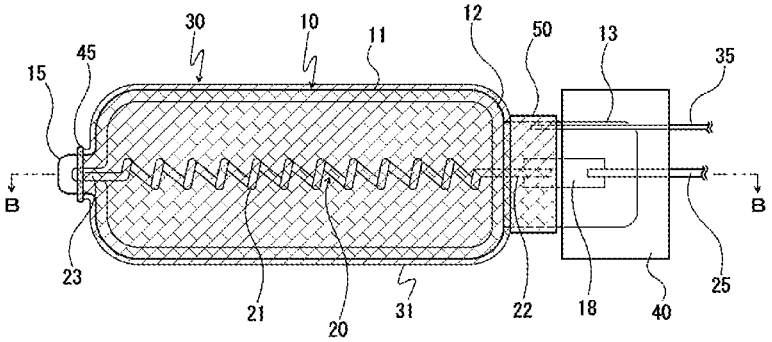
FIG. 2A is a plain view schematically showing another exemplary configuration according to another embodiment of the excimer discharge lamp of the present invention.
Figure 2B:
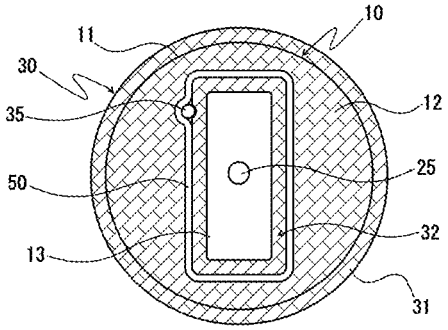
FIG. 2B is a side view showing the excimer discharge lamp shown in FIG. 2A observed from outside of one end of the excimer discharge lamp in the longitudinal direction in which a part of the excimer discharge lamp is partially omitted.
Figure 2C:
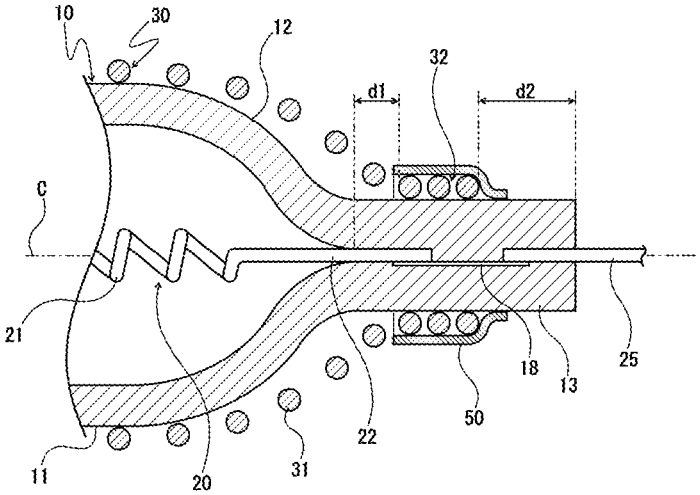
FIG. 2C is an enlarged cross sectional view showing a part of the excimer discharge lamp along B-B line shown in FIG. 2A.

FIG. 2A is a plain view schematically showing another configuration according to another exemplary embodiment of the excimer discharge lamp of the present invention. FIG. 2B is a side view showing the excimer discharge lamp shown in FIG. 2A observed from outside of one end in the longitudinal direction with a part of the excimer discharge lamp being partially omitted. FIG. 2C is an enlarged cross sectional view showing a part of the excimer discharge lamp shown in FIG. 2A along B-B line.

The excimer discharge lamp according to second embodiment has an identical configuration as the excimer discharge lamp shown in FIGS. 1A and 1B, except that the excimer discharge lamp according to second embodiment employs a different fixing method of the outer electrode 30 from one in first embodiment. In FIGS. 2A to 2C, identical components (elements) to ones in the excimer discharge lamp shown in FIGS. 1A and 1B are denoted with identical reference signs and the redundant explanation would be omitted.

In the excimer discharge lamp according to second embodiment, one end of the outer electrode 30 is retained (hold) and fixed such that the one end of the outer electrode 30 is positioned on the outer surface of the sealing portion 13 formed in the arc tube 10 and retained and fixed by a planar retaining member that allows the one end of the outer electrode 30 to be contact (or surface contact) the outer surface of the sealing portion 13.

A particular fixing method of the outer electrode 30 will be described below in detail. One end of the net-like electrode forming member 31, which constitutes the outer electrode 30, is positioned in the state that the metal element wire closely contacts the outer surface of the sealing portion 13 at a position outside from one end of the reduced diameter portion 12 in the tube axis direction of the arc tube 10, in other word, at a position on the outer face (surface) of the sealing portion 13.

Furthermore, the one end of the outer electrode 30 is fixed to the sealing portion 13 by winding the retaining member 50 with the prescribed width dimension, which is composed of a metal tape or a resin tape, around the metal element wire part 32, which closely contacts the outer face of the sealing portion 13. In addition, one end of the net-like electrode forming member 31 is fixed at a position on the outer peripheral surface of the tip portion 15 with the one end of the net-like electrode forming member 31 being wound by the electrode fixing wire 45 composed of, for example, the Ni wire.

A distance in the axis direction d1 is preferably equal to or greater than 1 mm, for example, 1 to 15 mm that is between an inner end of the metal element wire part 32, which closely contacts the outer face of the sealing portion 13 (that is, a position at which the metal element wire positioned at the innermost side in FIG. 2C is arranged), and a boundary position between the reduced diameter portion 12 and the sealing portion 13. When the distance in the axis direction d1 is less than 1 mm, then the discharge is likely to occur between the inner electrode 20 and the outer electrode 30 via the reduced diameter portion 12 of the arc tube 10, and the ultraviolet light distortion due to the irradiation of the ultraviolet light is likely to be accumulated in the reduced diameter portion 12.

Also, a distance in the axis direction d2 is preferably equal to or greater than 1 mm, for example, 1 to 3 mm that is between an outer end of the metal element wire part 32, which closely contacts the outer face of the sealing portion 13 (that is, a position at which the metal element wire positioned at the outermost side in FIG. 2C is arranged), and an outer end of the sealing portion 13. When the distance in the axis direction d2 is less than 1 mm, then a creepage (creeping) distance of insulation between the outer electrode 30 and the inner electrode 20 is likely to become insufficient, the insulation breakdown is likely to occur on the sealing portion 13 due to the creeping (surface) discharge so that the lamp is unlikely to be lit on.

As a material for constituting the retaining member 50, for example, molybdenum, aluminum, copper, a fluorine based resin, or a silicone resin or the like may be enumerated.

The width of the retaining member 50 (that is, the dimension in the axis direction) is preferably equal to or greater than 5 mm, for example, 5 to 10 mm. By configuring the retaining member 50 in that way, it makes it possible to ensure the state that the retaining member 50 contacts (or surface contacts) the net-like electrode forming member 31, which constitutes the outer electrode 30. Furthermore, as the area of contact becomes larger, it makes it possible to reduce the mechanical stress when the outer electrode 30 is fixed.

Figure 3:
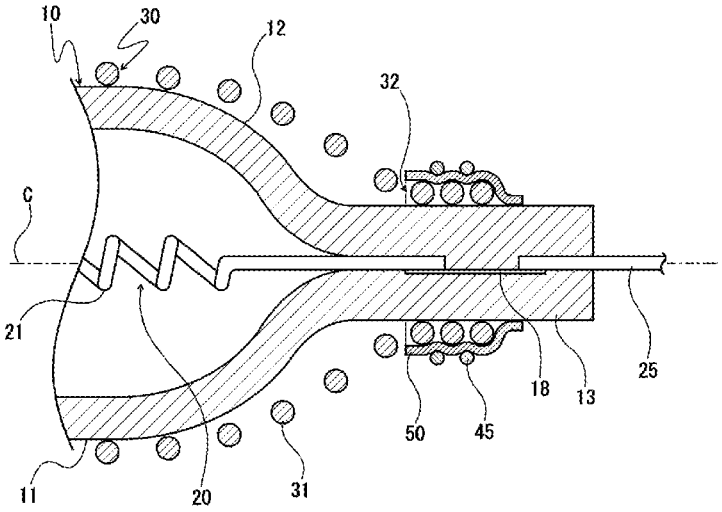
FIG. 3 is an enlarged cross sectional view showing a part of yet another exemplary configuration according to yet another embodiment of the excimer discharge lamp of the present invention.

In addition or alternatively, when the outer electrode 30 is fixed, as shown in FIG. 3, the electrode fixing wire 45 composed of, for example, the Ni wire, may be further wound around the outer peripheral surface of the retaining member 50.

As described above, the above configured excimer discharge lamp according to second embodiment can achieve the similar effect as the excimer discharge lamp according to first embodiment. More particularly in other word, according to the above configured excimer discharge lamp of second embodiment, it makes it possible to reduce the mechanical stress acting to the reduced diameter portion 12 of the arc tube 10, which occurs with the outer electrode 30 being fixed by winding the planar shaped retaining member 50 so that it makes it possible to avoid the stress concentration to occur in the reduced diameter portion 12.

Furthermore, because the metal element wire of the net-like electrode forming member 31, which constitutes the outer electrode 30, is positioned apart from the outer surface of the reduced diameter portion 12, it makes it possible to suppress the vacuum ultraviolet light to emit in the reduced diameter portion 12 and also to mitigate the ultraviolet light distortion to be accumulated in the reduced diameter portion 12. As a result, the lamp breakage in the last phase of the life of lamp can be prevented in an ensured manner so that a desired life of lamp can be achieved in an ensured manner.

Figure 4:
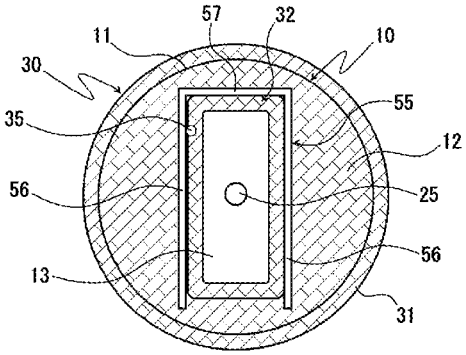
FIG. 4 is a side view showing yet another exemplary configuration according to yet another embodiment of the excimer discharge lamp of the present invention observed from outside of one end of the excimer discharge lamp in the longitudinal direction in which a part of the excimer discharge lamp is partially omitted.

In the above description and throughout the specification and claims, the planar retaining member, which allows one end of the outer electrode 30 to contact (or surface contact) the outer face of the sealing portion 13, is not limited to the metal tape or the resin tape, but may be alternatively configured with a clipping member 55 that clamps to retain the outer electrode 30 and the sealing portion 13, as, for example, shown in FIG. 4.

The clipping member 55 in the example in FIG. 4 has a side shape of the U-shape, and comprises a pair of plate like clamping parts 56, 56, which face each other to extend, and a plate like coupling part 57, which couples one clamping part 56 to the other clamping part 56.

As a material constituting the clipping member 55, any material having resilience can be used, and for example, a metal material such as a stainless steel, molybdenum, aluminum, or a resin material such as a fluorine based resin may be enumerated.

Next, a particular fixing method of the outer electrode 30 by the clipping member 55 will be described below in detail. One end of the net-like electrode forming member 31, which constitutes the outer electrode 30, is positioned in the state that the metal element wire closely contacts the outer face of the sealing portion 13 at a position outside the one end of the reduced diameter portion 12 in the tube axis direction of the arc tube 10, in other word, at a position on the outer face of the sealing portion 13 (see, e.g., in FIG. 2C).

Subsequently, the clipping member 55 is mounted to the metal element wire part 32 closely contacting the outer face of the sealing portion 13 so that a pair of the clamping parts 56, 56 clamp and retain the sealing portion 13, which is formed by, for example, the pinch seal method, and the net-like electrode forming member 31. Accordingly, the one end of the outer electrode 30 is fixed in a state that the one end of the outer electrode 30 contacts (or surface contacts) the sealing portion 13.

The width of the clipping member 55 (that is, a dimension in the tube axis direction) is preferably equal to or greater than 5 mm, for example, 5 to 10 mm. By configuring the clipping member 55 in this manner, it makes it possible to ensure the state that the clipping member 55 contacts (or surface contacts) the net-like electrode forming member 31, which constitutes the outer electrode 30, so that it makes it possible to reduce the mechanical stress when the outer electrode 30 is fixed in an ensured manner, because the area of contact becomes larger.

Various embodiments of the present invention have been described above. Nevertheless, the present invention is not limited to the above mentioned embodiments but various modifications can be apparently applied.

Figure 5:
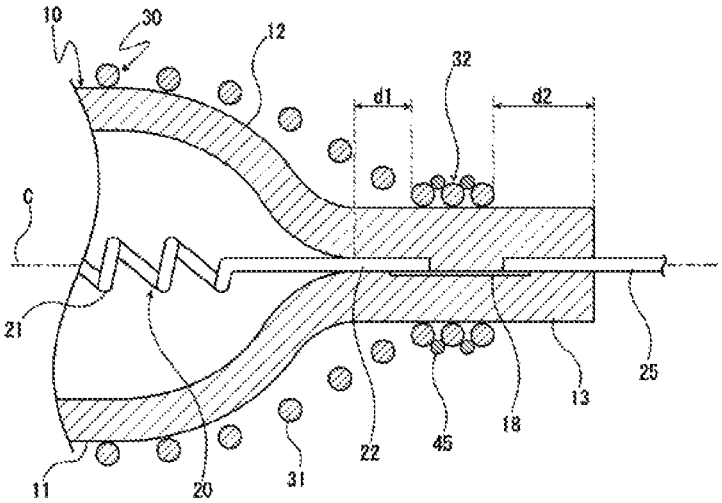
FIG. 5 is an enlarged cross sectional view showing a part of yet another exemplary configuration according to yet another embodiment of the excimer discharge lamp of the present invention.
Figure 6:
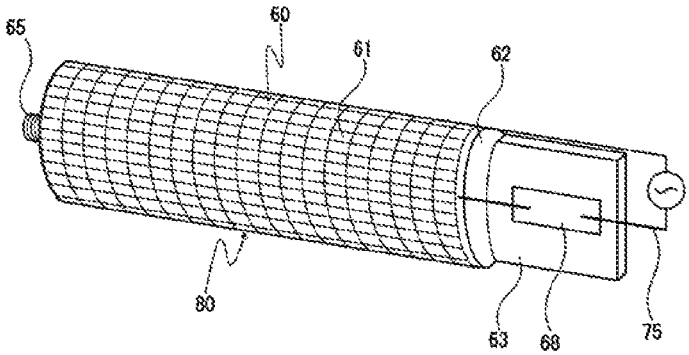
FIG. 6 is a perspective view schematically showing an exemplary configuration of the conventional excimer discharge lamp.
Figure 7:
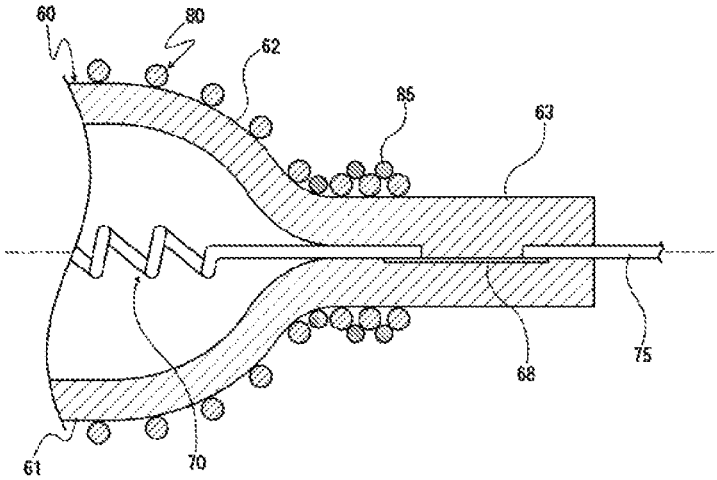
FIG. 7 is an enlarged cross sectional view showing a configuration of a main part of the conventional excimer discharge lamp shown in FIG. 6.

For example, as shown in FIG. 5, alternatively or in addition, the one end of the outer electrode 30 may be fixed by winding the electrode fixing wire 45, which is composed of, for example, the Ni wire, around the metal element wire part 32 that closely contacts the sealing portion 13 at a position on the outer face of the sealing portion 13 in a state that the metal element wire is arranged in closely contacting the outer face of the sealing portion 13. This fixing method can also achieve the similar effect as the above embodiments with the distance in the axis direction d1 being set equal to or greater than the prescribed value that is between the inner end of the metal element wire part 32 that closely contacts the outer face of the sealing portion 13 (that is, a position at which the metal element wire positioned at innermost side in FIG. 5 is arranged) and the boundary position between the reduced diameter portion 12 and the sealing portion 13.

Furthermore, the above mentioned embodiments describe the excimer discharge lamp having a configuration in which the sealing portion with the pinch seal structure is formed at one end of the arc tube. Nevertheless, the sealing portion with the pinch seal structure may have, alternatively or additionally, a configuration in which the sealing portions with the pinch seal structure are formed, for example, at both end of the arc tube.

The structure of the sealing portion is not limited to the pinch seal structure, but may employ, alternatively or in addition, the shrink seal structure in which the arc tube 10 is sealed by reducing diameter from all circumferential directions of the outer circumference of the arc tube forming material. In the examiner discharge lamp with this type of sealing structure, it also make it possible to avoid the stress concentration to occur in the reduced diameter portion 12 of the arc tube 10, because the end of the outer electrode is fixed on the outer peripheral face of the sealing portion.

Furthermore, because the metal element wire of the net-like electrode forming material constituting the outer electrode can be positioned apart from the outer surface of the reduced diameter portion, it also makes it possible to suppress the vacuum ultraviolet light to emit in the reduced diameter portion 12 so that it also makes it possible to mitigate the ultraviolet distortion to be accumulated in the reduced diameter portion.

Yet furthermore, the excimer discharge lamp according to the present embodiments may be provided with a phosphor (fluorescent material) layer which is formed on an inner surface of the arc tube.

While certain embodiments have been described, these embodiments have been presented by way of example only, and are not intended to limit the scope of the present invention. The novel apparatuses and methods thereof described herein may be embodied in a variety of other forms. Furthermore, various omissions, substitutions and changes in the form of the apparatuses and methods thereof described herein may be made without departing from the gist of the present invention. The accompanying claims and their equivalents are intended to cover such forms or modifications as would fall within the scope and gist of the present invention.

The present application is based upon and claims the benefit of a priority from Japanese Patent Application No. 2015-020131, filed on Feb. 4, 2015, and the entire contents of which are incorporated herein by reference.

REFERENCE SIGNS LIST

10 Arc Tube
11 Luminous Portion
12 Reduced Diameter Portion
13 Sealing Portion
15 Tip Portion
18 Metallic Foil
20 Inner Electrode
21 Coiled Part
22 One Lead Part
23 The Other Lead Part
25 Outer Lead
25 Outer Electrode
31 Net-like (Reticular) Electrode Forming Member
32 Metal Element Wire Part
35 Wiring
40 One Base Member
41 The Other Base Member
42 Groove Portion
45 Electrode Fixing Wire (Ni Wire)
50 Retaining Member
55 Clipping Member
56 Clamping Portion
57 Coupling Portion
60 Arc Tube
61 Luminous Portion
62 Reduced Diameter Portion
63 Sealing Portion
65 Tip Portion
68 Metallic Foil
70 Inner Electrode
75 Outer Lead
80 Outer Electrode
85 Metal Wire
C Tube Axis of Arc Tube

What is claimed is:

1. An excimer discharge lamp, comprising:

an arc tube for enclosing a luminous gas inside and having a sealing portion formed contiguous to, via a reduced diameter portion, one end of a tube shaped luminous portion; and an outer electrode of a net shape arranged on an outer peripheral surface of the arc tube, and one end of the outer electrode being fixed via an outer electrode fixing member provided on an outer surface of the sealing portion.

2. An excimer discharge lamp, comprising:

an arc tube for enclosing a luminous gas inside and having a sealing portion formed contiguous to, via a reduced diameter portion, one end of a tube shaped luminous portion; and an outer electrode of a net shape arranged on an outer peripheral surface of the arc, and one end of the outer electrode being retained and fixed by a retaining member that allows the one end of the outer electrode to surface contact an outer surface of the sealing portion in a state that the one end of the outer electrode is positioned on the outer surface of the sealing portion.

3. The excimer discharge lamp according to claim 1, wherein the outer electrode fixing member is configured with a base member attached to the sealing portion.

* * * * *